US011182989B1

(12) United States Patent
Giles et al.

(10) Patent No.: US 11,182,989 B1
(45) Date of Patent: Nov. 23, 2021

(54) CONTROLLED INDOOR ACCESS USING SMART INDOOR DOOR KNOBS

(71) Applicant: Alarm.com Incorporated, Tysons, VA (US)

(72) Inventors: Chad Giles, St. Paul, MN (US); Linnea Giles, St. Paul, MN (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

(21) Appl. No.: 16/939,426

(22) Filed: Jul. 27, 2020

Related U.S. Application Data

(63) Continuation of application No. 16/450,292, filed on Jun. 24, 2019, now Pat. No. 10,726,650, which is a continuation of application No. 15/858,391, filed on Dec. 29, 2017, now Pat. No. 10,360,746.

(60) Provisional application No. 62/440,899, filed on Dec. 30, 2016.

(51) Int. Cl.
*G07C 9/00* (2020.01)
*G08B 25/00* (2006.01)

(52) U.S. Cl.
CPC ..... *G07C 9/00309* (2013.01); *G08B 25/008* (2013.01); *G07C 2009/00507* (2013.01)

(58) Field of Classification Search
None
See application file for complete search history.

(56) References Cited

U.S. PATENT DOCUMENTS

| | | | | |
|---|---|---|---|---|
| 3,890,608 | A | 6/1975 | Peterson | |
| 4,907,429 | A | 3/1990 | Davis et al. | |
| 5,490,678 | A | 2/1996 | Darnell | |
| 6,927,669 | B2 | 8/2005 | Tanaka | |
| 7,117,043 | B1 | 10/2006 | Frederick et al. | |
| 8,488,311 | B2 | 7/2013 | Tsai | |
| 9,359,794 | B2 * | 6/2016 | Cheng | E05B 47/026 |
| 10,075,334 | B1 | 9/2018 | Kozura et al. | |
| 2002/0043024 | A1 | 4/2002 | Tanaka | |
| 2002/0186121 | A1 * | 12/2002 | Yoshikawa | G07C 9/28 340/5.28 |
| 2005/0116480 | A1 | 6/2005 | Deng et al. | |
| 2006/0250235 | A1 | 11/2006 | Astrin | |

(Continued)

FOREIGN PATENT DOCUMENTS

| | | | |
|---|---|---|---|
| CA | 2827516 A1 * | 8/2012 | G07C 9/00571 |
| CN | 201562306 | 8/2010 | |
| CN | 201687294 | 12/2010 | |

*Primary Examiner* — Chico A Foxx
(74) *Attorney, Agent, or Firm* — Fish & Richardson P.C.

(57) ABSTRACT

A method includes receiving, by an armed monitoring system of a property and from a user, a disarm code, comparing the received disarm code to a stored disarm code, determining that the received disarm code matches the stored disarm code, determining a property access pattern that corresponds to the stored disarm code, that identifies a first door group of one or more doors inside the property that should be locked, and that identifies a second door group of one or more doors inside the property that should be unlocked, providing, to the first door group, a first instruction to lock, providing, to the second door group, a second instruction to unlock, and based on providing, to the first door group, the first instruction to lock and providing, to the second door group, the second instruction to unlock, disarming the monitoring system.

20 Claims, 6 Drawing Sheets

(56) References Cited

U.S. PATENT DOCUMENTS

2006/0293892 A1 12/2006 Pathuel
2007/0168674 A1 7/2007 Nonaka et al.
2007/0200666 A1 8/2007 Howard
2008/0236213 A1 10/2008 Blanch
2008/0254786 A1 10/2008 Brink et al.
2009/0064744 A1 3/2009 Wang
2009/0224879 A1* 9/2009 Nakazawa ..... G07C 9/00309 340/5.72
2010/0176917 A1 7/2010 Bacarella
2012/0252365 A1 10/2012 Lam
2012/0280783 A1* 11/2012 Gerhardt ..... H04W 12/08 340/5.6
2013/0335222 A1 12/2013 Comerford et al.
2013/0342314 A1 12/2013 Chen
2014/0132393 A1* 5/2014 Evans ..... G08B 21/02 340/6.11
2014/0260448 A1 9/2014 Beck et al.
2015/0199863 A1* 7/2015 Scoggins ..... G07C 9/00571 340/5.25
2015/0221148 A1* 8/2015 Schuster ..... G07C 9/00309 340/5.61
2015/0356801 A1* 12/2015 Nitu ..... G07C 9/00904 340/5.61
2015/0379795 A1 12/2015 Wu
2016/0055698 A1* 2/2016 Gudmundsson ... G07C 9/00571 340/5.52
2016/0066254 A1 3/2016 Colby et al.
2016/0098876 A1* 4/2016 Oz ..... H04W 4/023 340/5.61
2016/0261425 A1 9/2016 Horton et al.
2016/0343185 A1 11/2016 Dumas
2016/0353239 A1* 12/2016 Kjellsson ..... H04W 4/021
2017/0002586 A1* 1/2017 Lee ..... G07C 9/00817
2017/0064261 A1 3/2017 Peng et al.
2017/0185281 A1 6/2017 Park et al.
2017/0185538 A1 6/2017 Khan et al.
2018/0005143 A1* 1/2018 Camargo ..... G07C 9/00309
2018/0041528 A1 2/2018 Machlica et al.
2018/0108196 A1 4/2018 Abner
2018/0158310 A1 6/2018 Sieck
2018/0165631 A1 6/2018 Romero et al.
2018/0322759 A1 11/2018 Devdas et al.
2019/0088097 A1* 3/2019 Jacobs ..... G08B 13/19695
2019/0122521 A1 4/2019 Devdas et al.

* cited by examiner

| Door knob location | Code / Condition | | | | |
|---|---|---|---|---|---|
| | 1234 | 5678 | Arm Stay | Arm away | Alarm Event |
| Master bedroom | lock | lock | unlock | lock | unlock |
| Kid bedroom | lock | lock | unlock | lock | unlock |
| Basement | unlock | unlock | lock | lock | unlock |
| Garage | lock | unlock | lock | unlock | unlock |
| HVAC | lock | unlock | lock | lock | unlock |

| | |
|---|---|
| Master bedroom | lock |
| Kid bedroom | lock |
| Basement | unlock |
| Garage | unlock |
| HVAC | unlock |

CONTROLLED INDOOR ACCESS USING SMART INDOOR DOOR KNOBS

CROSS REFERENCE TO RELATED APPLICATIONS

This application is a continuation of Ser. No. 16/450,292, filed Jun. 24, 2019, which is a continuation of Ser. No. 15/858,391, filed Dec. 29, 2017, now U.S. Pat. No. 10,360,746, issued Jul. 23, 2019, which claims benefit of U.S. Provisional Application No. 62/440,899, filed Dec. 30, 2016, and titled "Controlled Indoor Access using Smart Indoor Door Knobs." The complete disclosures of all of the above patent applications are hereby incorporated by reference in their entirety for all purposes.

TECHNICAL FIELD

This disclosure relates to property monitoring technology and, for example, controlling indoor access by integrating indoor door knobs into a property monitoring system.

BACKGROUND

Many people equip homes and businesses with monitoring systems to provide increased security for their homes and businesses.

SUMMARY

Techniques are described for monitoring technology. For example, techniques are described for integrating indoor door knobs into a monitoring system to allow for connected access control inside a property.

According to an innovative aspect of the subject matter described in this application, a monitoring system includes a monitor control unit that is configured to receive user input, and one or more door knobs that are located on doors inside a property and that are configured to lock and unlock in response to instructions from the monitor control unit. The monitor control unit is configured to receive a disarm code from a user, compare the received disarm code to a stored disarm code, based on comparing the received disarm code to the stored disarm code, determine that the received disarm code matches the stored disarm code, based on determining that the received disarm code matches the stored disarm code, determine a property access pattern that corresponds to the stored disarm code, that identifies a first door group of one or more doors inside the property that should be locked, and that identifies a second door group of one or more doors inside the property that should be unlocked, provide, to the first door group, a first instruction to lock, provide, to the second door group, a second instruction to unlock, and based on providing, to the first door group, the first instruction to lock and provide, to the second door group, the second instruction to unlock, disarming the monitoring system.

These and other implementations each optionally include one or more of the following optional features. The monitor control unit is configured to determine that the received disarm code matches the stored disarm code by determining that the received disarm code matches the stored disarm code that is among multiple disarm codes, and where each of the multiple disarm codes corresponds to a different property access pattern. The monitor control unit is configured to receive a request to arm the monitoring system in armed stay mode, based on the request to arm the monitoring system in the armed stay mode, determine a second property access pattern that corresponds to the armed stay mode, that identifies a third door group of one or more doors inside the property that should be locked, and that identifies a fourth door group of one or more doors inside the property that should be unlocked, provide, to the third door group, a third instruction to lock, and provide, to the fourth door group, a fourth instruction to unlock, and based on providing, to the third door group, the third instruction to lock and providing, to the fourth door group, the fourth instruction to unlock, arm the monitoring system in armed stay mode.

The monitor control unit is further configured to receive, a request to arm the monitoring system in armed away mode, based on the request to arm the monitoring system in the armed away mode, determine a third property access pattern that corresponds to the armed away mode, that identifies a fifth door group of one or more doors inside the property that should be locked, and that identifies a sixth door group of one or more doors inside the property that should be unlocked, provide, to the fifth door group, a fifth instruction to lock, provide, to the sixth door group, a sixth instruction to unlock, and based on providing, to the fifth door group, the fifth instruction to lock and providing, to the sixth door group, the sixth instruction to unlock, arm the monitoring system in armed away mode. The monitor control unit is further configured to receive, for a visitor to the property, a request to generate the stored disarm code, receive data identifying an area of the property to prevent the visitor from accessing while the visitor is inside the property, and based on the data identifying the area of the property to prevent the visitor from accessing while the visitor is inside the property, generate the property access pattern that identifies the first door group of the one or more doors inside the property that should be locked, and that identifies a second door group of the one or more doors inside the property that should be unlocked.

The monitoring system further includes, one or more sensors that are located at the property and that are configured to provide sensor data to the monitor control unit, where the monitor control unit is further configured to analyze the sensor data, based on analyzing the sensor data, determine a third door group of one or more doors inside the property that should be locked and a fourth door group of one or more doors inside the property that should be unlocked, provide, to the third door group, a third instruction to lock, and provide, to the fourth door group, a fourth instruction to unlock. The monitor control unit is further configured to analyze the sensor data by determining that the sensor data indicates an emergency event, and the third group of one or more doors inside the property that should be locked includes no doors inside the property and the fourth door group of one or more doors inside the property that should be unlocked includes all doors inside the property. The monitor control unit is further configured to analyze the sensor data by determining that an unauthorized person is located in a room of the property, and the third group of one or more doors inside the property that should be locked includes doors of the room and the fourth door group of one or more doors inside the property that should be unlocked includes doors other than the doors of the room.

The monitor control unit is further configured to receive, crime data for a geographic area of the monitored property, analyze the crime data, based on analyzing the crime data, determine a third door group of one or more doors inside the property that should be locked and a fourth group of one or more doors inside the property that should be unlocked, provide, to the third door group, a third instruction to lock, provide, to the second door group, a second instruction to unlock, and based on providing, to the third door group, the third instruction to lock and providing, to the forth door group, the forth instruction to unlock, arm the monitoring system. The monitor control unit is further configured to determine that a door in the first door group is unable to lock or that a door in the second group is unable to unlock, generate a notification that indicates that the door in the first door group is unable to lock or that the door in the second group is unable to unlock, and provide, for output, the notification.

Implementations of the described techniques may include hardware, a method or process implemented at least partially in hardware, or a computer-readable storage medium encoded with executable instructions that, when executed by a processor, perform operations.

The details of one or more implementations are set forth in the accompanying drawings and the description below. Other features will be apparent from the description and drawings, and from the claims.

DETAILED DESCRIPTION

Techniques are described for integrating indoor door knobs into a monitoring system to allow for connected access control inside a property. A property may be equipped with one or more doors that each include a smart door knob that is configured with Bluetooth capability, Z-wave capability, or other radio frequency (RF) communication protocols, and directly connects to a user's mobile device. The user may control the locking and/or unlocking of the smart door knobs through a native application on the user device. The one or more smart door knobs may be integrated into a monitoring system at the property, and the user may set specific lock/unlock patterns for each of the door knobs within the property based on detected conditions and timing schedules. A control unit that controls the monitoring system at the property may store the user specified door knob lock/unlock patterns, and may communicate commands to lock and/or unlock each of the one or more door knobs at the property based on the specified lock/unlock pattern. For example, the control unit may command each of the indoor door knobs to lock when the user arms the monitoring system. In some examples, the user may also control the locking and/or unlocking of the smart door knob locally.

Figure 1:
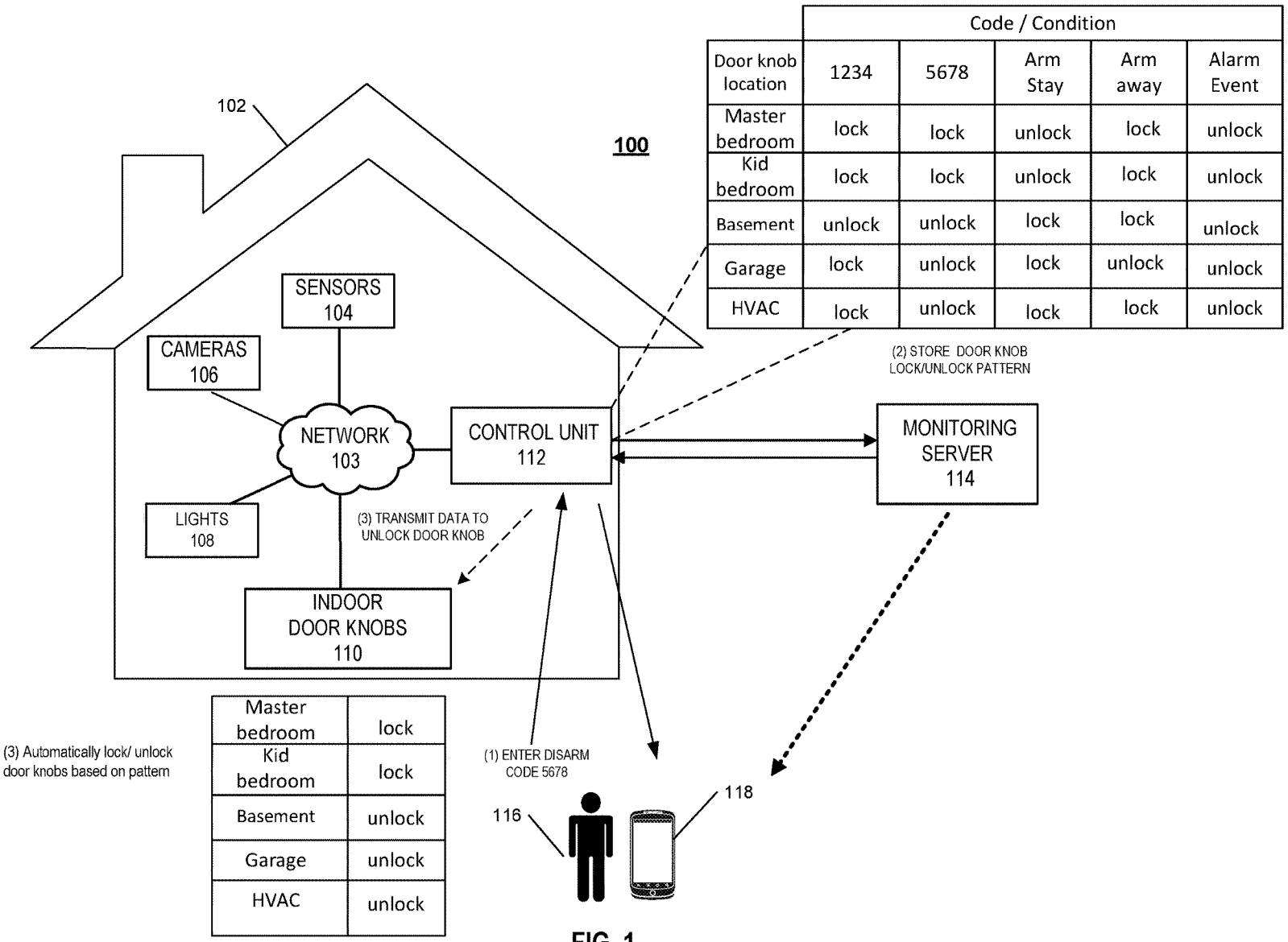
FIG. 1 illustrates an example of a system for controlling access in a property.

FIG. 1 illustrates an example of a monitoring system 100 integrated with smart indoor door knobs 110. As shown in FIG. 1, a property 102 (e.g. a home) of a user 116 is monitored by an in-home monitoring system (e.g., in-home security system) that includes components that are fixed within the property 102. The in-home monitoring system may include a control unit 112, one or more sensors 104, one or more cameras 106, one or more lights 108, and one or more indoor door knobs 110. The in-home monitoring system may be integrated with one or more indoor door knobs 110 that are each mounted to the indoor doors within the monitored property. For example, a smart door knob may be mounted to the door of a bedroom, bathroom, or pantry. The smart indoor door knob may be used on any door that can be opened and closed. In some implementations, the smart indoor door knob may be configured to lock from either side. In these implementations, the user may lock a smart lock to prevent another using from entering or exiting a particular room. The user may configure the side of the smart lock that should be locked and/or unlocked through the application on the user device.

The smart indoor door knob may replace a regular manual door knob, or in some examples may be used in conjunction with a regular manual knob. In the examples where the smart door knob replaces a regular manual door knob, the smart door knob may have a similar size and physical appearance of a manual door knob. A user may remove the manual knob and install a smart door knob in its place. In the examples where the smart indoor door knob is used in conjunction with a manual lock, the smart door knob may be mounted to the perimeter of a door and may include an extendable arm that is configured to extend towards the door to allow the arm to lock the door closed, and the arm may be retracted to unlock the door.

The smart indoor door knob may have Bluetooth capability and include an LED status indicator. The status indicator LED may light red when the door knob is locked, and may light green when the door knob is unlocked. In some examples, the LED may light in a variety of colors. Each light color may indicate a different state of the door knob. In these examples, the user may have the ability to change the color of the LED based on preference. In some examples, the smart door knob may include a speaker that generates a sound when the door knob is locked and or unlocked. The one or more sensors 104 may be any type of electronic sensors and may be located throughout the monitored property 102. The monitored property 102 may include a smart front door lock and a front door doorbell camera. In some implementations, where the smart indoor door knob is configured to lock from either side, a status indicator LED may be located on either side of the door.

In the example shown in FIG. 1, the user 116 may enter a disarm code into the control unit 112. The control unit 112 may include a user interface that allows the user to arm and disarm the in-home monitoring system. When the user 116 enters an authentic disarm code into the control unit 112, the control unit 112 disarms the in-home monitoring system, and automatically locks or unlocks one or more smart door knobs within the monitored property 102 based on a door knob lock/unlock pattern associated with the entered code. The disarm code entered by a user is a user specific PIN code that is associated with instructions for which of the one or more indoor door knobs should be locked, and which should be unlocked when the particular code is entered. For the example illustrated in FIG. 1, when the user enters the disarm code 5678, the instructions include that the door knobs on the doors to each of the master bedroom and the kid bedroom should be locked, and the door knobs on the doors to each of the basement, garage, and HVAC room should be unlocked.

A user associated with the monitored property 102 may configure the door knob lock/unlock pattern for each of a one or more disarm codes. The user may configure the system by logging into a website supported by the monitoring system, or by accessing an application that is hosted on a mobile device. The user may assign a specific code for each of the members of the family associated with the monitored property, and may assign the door knob lock/unlock pattern based on the preferred level of access for each of the family members. For example, the father may be assigned a disarm code that is associated with one particular door knob lock/unlock pattern, and the mother may be assigned a different disarm code that is associated with a different door knob lock/unlock pattern. In some examples, each of the family members associated with the property may use a single disarm code and therefore have the same level of access when the in-home security system is disarmed.

The user associated with the monitored property 102 may configure the system with one or more disarm codes for visitors to the property. The user may assign disarm codes that allow different visitors to have different levels of access to the rooms of the property based on the door knob lock/unlock pattern associated with the assigned disarm code. For example, the user may assign a disarm code for a dog walker and assign the door knob lock/unlock pattern based on the disarm code. The code assigned to the dog walker only unlocks the door knobs to the doors that are used to access the dog and the leash. For example, the code may unlock the door knobs to the doors to the main living area, and lock all the other door knobs within the property. In another example, the user may assign a disarm code for a technician or contractor that is scheduled to visit the property when the user is not present, and may assign the door knob lock/unlock pattern based on the disarm code. The code assigned to the technician or contractor unlocks the door knobs to the doors that lead to the rooms that the contractor would need to access to complete the task. For example, a plumber may be scheduled to fix a leak in a bathroom in the upper level of the monitored property. The code assigned to the plumber may unlock the door knobs along a path to the bathroom and lock all the other indoor door knobs at the property.

The user associated with the monitored property may configure the access level to rooms within the property based on a current arming status of the in-home monitoring system. The user may configure different door knob lock/unlock patterns based on whether the in-home system is in arm away mode or arm stay mode. For example, when the in-home monitoring system is armed away, the user may configure all the door knobs within the property to be locked. This may be helpful to limit access to all rooms of the property if the in-home monitoring system was breached during a burglary. When a burglar enters a property, he may only have a short time to grab belongings before the authorities would arrive, limiting access to the rooms of the property would limit access to valuables. For example, with bedroom and closet doors locked, the burglar may have difficulty accessing the bedrooms and closets of the property to steal jewelry. The user may be present in the property when the system is armed stay, and may configure the door knobs lock/unlock pattern for added security within the property. For example, the user may configure the door knob on the door to the basement to be locked to prevent burglars from entering the main living area of the property.

The door knob lock/unlock patterns which control access within the monitored property may be set by the user associated with the property based on the user's preferences. In some implementations, the door knob lock/unlock patterns may be received from a monitoring server 114. The monitoring server 114 is a remote server that communicates with one or more other in-home monitoring systems. The monitoring server 114 may receive data from the one or more other in-home monitoring systems and determine door knob lock/unlock patterns based on the received data. For example, the monitoring server 114 may receive data reporting several burglaries within the past hour in a local area of the monitored property 102. The monitoring server 114 may communicate to the control unit 112 at the monitored property to lock all door knobs, based on determining that the in-home monitoring system at the property was armed away, and only a subset of the door knobs were configured to be locked by the user in this armed state. The monitoring server 114 may send a notification to the mobile device 118 of the user 116 to notify the user of the updated door knob lock/unlock pattern, and the reason for the update.

The control unit 112 stores the user configured door knob lock/unlock patterns in memory. As illustrated, the control unit 112 may store the user configured disarm codes and the associated door knob lock/unlock pattern in its memory. The control unit 112 may also store the associated door knob lock/unlock patterns for each of the one or more arming statuses of the in-home monitoring system. The control unit 112 may also store door knob lock/unlock patterns based on detected alarm events. The door knob lock/unlock patterns based on detected alarm events may be configured by the user. In some examples, the door knob lock/unlock pattern may be determined algorithmically by the control unit based on the particular detected event, the location of the detected event, and the location of the occupants within the property. In some implementations, the user configured door knob lock/unlock patterns may be stored at the monitoring server 114 and communicated to the control unit 112.

The control unit 112 communicates the door knob lock/unlock pattern to the one or more door knobs within the property, and automatically locks/unlocks the specific doors based on the stored pattern data. The control unit may communicate with the one or more door knobs via Bluetooth, or in some examples may communicate with the one or more door knobs using wireless protocols such as Wi-Fi, Z-Wave, Zigbee, and "HomePlug," Powerline, or any other suitable communication protocol. For example, the control unit 112 may communicate commands to lock the door knob on the doors to the master bedroom, kid bedroom, garage, and HVAC, and lock the door knob on the door to the basement when the user enters the disarm code 1234.

The control unit 112 may communicate a notification to the mobile device 118 of the user 116 when the control unit receives an error message from one or more door knob. A door knob may generate an error message when it receives a command from the control unit to lock, but the door is not in a closed position. The generated notification may identify the door knob that generated the message and the location of the door knob.

The indoor door knobs may be used to restrict access to rooms within the monitored property 102. For example, a user may wish to restrict their kids and visitors from entering the gun storage room. The user may maintain the door knob on the door to the gun storage room in a locked position. The user may unlock the door knob through application on his mobile phone when he wants to access the storage room. The user may have the ability to automatically lock and unlock the door knobs based on a time schedule. The user may use the application to automatically lock/unlock specific door knobs based on the time of day. The user may set one or more schedules for each door knob at the monitored property. For example, the user may lock the door knob of the pantry between 8:00 PM to 6:00 AM. For another example, the user may lock the door to the entertainment room between 4:00 PM to 6:00 PM on Mondays to Thursdays so the kids can focus on doing homework instead of watching television or playing video games.

In some implementations, the control unit 112 may generate door knob status notifications. The user may configure a specific time frame for receiving door knob status notifications. For example, the user may specify to receive status notifications between 9:00 PM and 6:00 AM. The status indicators may be used to identify which of the unlocked door knobs were opened. The managing application may allow the user to acquire time logs for each opening of the one or more door knobs. In some implementations, the LED on the door knob may light orange to indicate when an unlocked door knob was opened. The LED status of the door knob may change to a default color status automatically based on an amount of time. In some implementations, the LED status of the door knob may change to a default color when the user accesses the native application on the user device to confirm a door is opened.

In some examples, the property 102 may not be monitored by an in-home monitoring system. In such examples, the user may lock and unlock door knobs through the use of a door knob application. The door knobs within the property 102 may be identified in the application, and the user may have the ability to switch the door from locked to unlocked, and from unlocked to lock.

Figure 2:
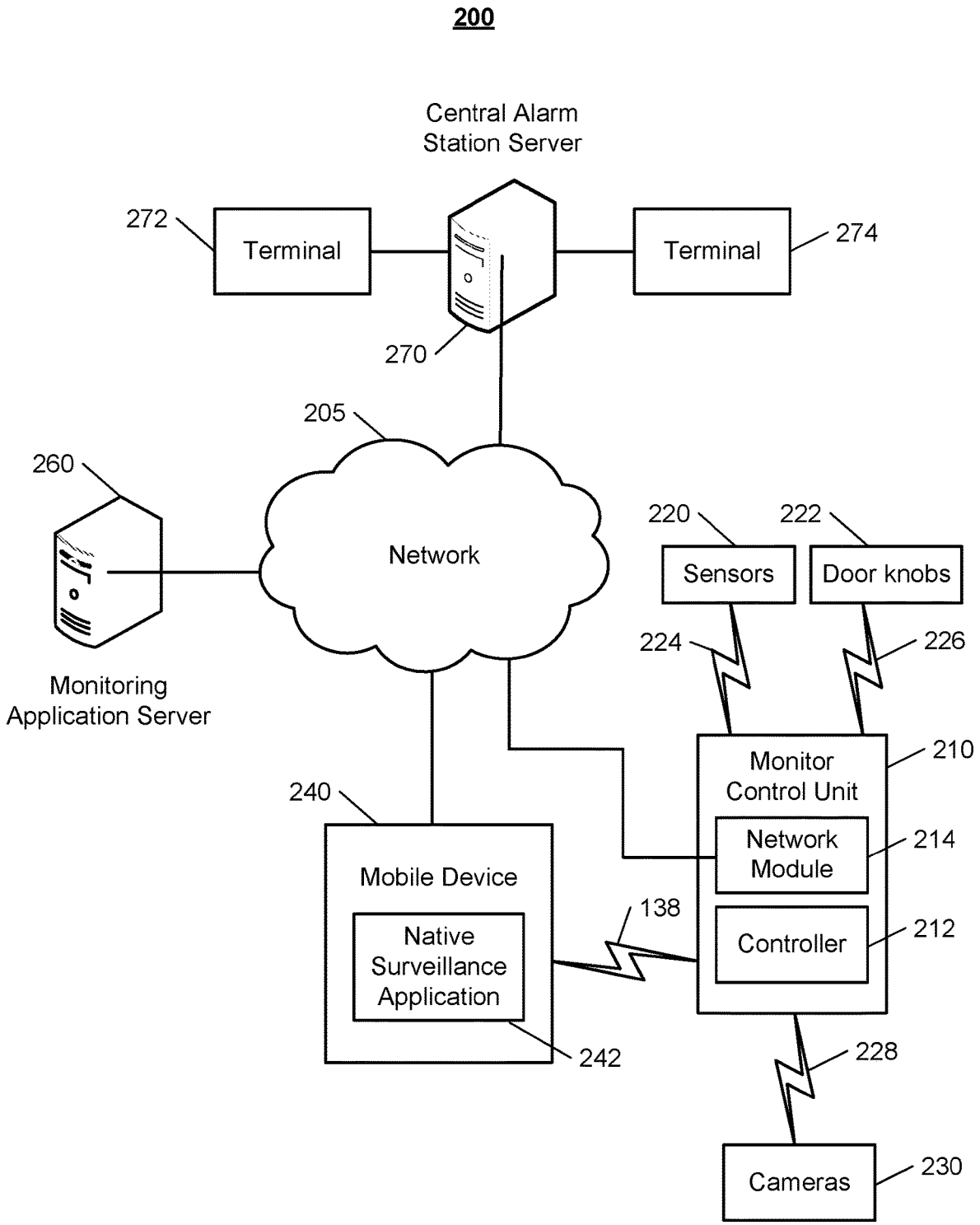
FIG. 2 illustrates an example of a monitoring system integrated with indoor door knobs.

FIG. 2 illustrates an example of a system 200 configured to monitor a property. The system 200 includes a network 205, a monitoring system control unit 210, one or more user devices 240, a monitoring application server 260, and a central alarm station server 270. The network 205 facilitates communications between the monitoring system control unit 210, the one or more user devices 240, the monitoring application server 260, and the central alarm station server 270. The network 205 is configured to enable exchange of electronic communications between devices connected to the network 205. For example, the network 205 may be configured to enable exchange of electronic communications between the monitoring system control unit 210, the one or more user devices 240, the monitoring application server 260, and the central alarm station server 270. The network 205 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Network 205 may include multiple networks or subnetworks, each of which may include, for example, a wired or wireless data pathway. The network 205 may include a circuit-switched network, a packet-switched data network, or any other network able to carry electronic communications (e.g., data or voice communications). For example, the network 205 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 205 may include one or more networks that include wireless data channels and wireless voice channels. The network 205 may be a wireless network, a broadband network, or a combination of networks including a wireless network and a broadband network.

The monitoring system control unit 210 includes a controller 212 and a network module 214. The controller 212 is configured to control a monitoring system (e.g., a home alarm or security system) that includes the monitor control unit 210. In some examples, the controller 212 may include a processor or other control circuitry configured to execute instructions of a program that controls operation of an alarm system. In these examples, the controller 212 may be configured to receive input from indoor door knobs, sensors, detectors, or other devices included in the alarm system and control operations of devices included in the alarm system or other household devices (e.g., a thermostat, an appliance, lights, etc.). For example, the controller 212 may be configured to control operation of the network module 214 included in the monitoring system control unit 210.

The network module 214 is a communication device configured to exchange communications over the network 205. The network module 214 may be a wireless communication module configured to exchange wireless communications over the network 205. For example, the network module 214 may be a wireless communication device configured to exchange communications over a wireless data channel and a wireless voice channel. In this example, the network module 214 may transmit alarm data over a wireless data channel and establish a two-way voice communication session over a wireless voice channel. The wireless communication device may include one or more of a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 214 also may be a wired communication module configured to exchange communications over the network 205 using a wired connection. For instance, the network module 214 may be a modem, a network interface card, or another type of network interface device. The network module 214 may be an Ethernet network card configured to enable the monitoring control unit 210 to communicate over a local area network and/or the Internet. The network module 214 also may be a voiceband modem configured to enable the alarm panel to communicate over the telephone lines of Plain Old Telephone Systems (POTS).

The monitoring system may include one or more smart door knobs 222. Each of the one or more smart door knobs may include a Bluetooth chip that allows the door knob to communicate with the mobile device of a user. In some implementations, the one or more smart door knobs may communicate with the monitor control unit 210 through Bluetooth, Z-Wave, or other Powerline networks that operate over AC wiring. The smart door knob may have a similar size and physical appearance of a manual door knob. In some examples, the smart door knob may be mounted to the perimeter of a door and may include an extendable arm that is configured to extend towards the door to allow the arm to lock the door closed, and the arm may be retracted to unlock the door. The smart door knob may include an LED status indicator. The status indicator LED may light red when the door knob is locked and may light green when the door knob is unlocked. In some examples, the smart door knob may include a speaker that generates a sound when the door knob is locked and or unlocked. The smart door knob may be hardwired to a voltage line for power, and may include a battery that may be used to power the door knob in the event of a power outage. In some examples, the smart door knob may include a battery that may store enough power to power the door knob for an extended period of time, e.g., one month.

The monitoring system may include multiple sensors 220. The sensors 220 may include a contact sensor, a motion sensor, a glass break sensor, or any other type of sensor included in an alarm system or security system. The sensors 220 also may include an environmental sensor, such as a temperature sensor, a water sensor, a rain sensor, a wind sensor, a light sensor, a smoke detector, a carbon monoxide detector, an air quality sensor, etc. The sensors 220 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the sensors 220 may include a radio-frequency identification (RFID) sensor that identifies a particular article that includes a pre-assigned RFID tag.

The one or more cameras 230 may be a video/photographic camera or other type of optical sensing device configured to capture images. For instance, the one or more cameras 230 may be configured to capture images of an area within a building monitored by the monitor control unit 210. The one or more cameras 230 may be configured to capture single, static images of the area and also video images of the area in which multiple images of the area are captured at a relatively high frequency (e.g., thirty images per second). The one or more cameras 230 may be controlled based on commands received from the monitor control unit 210.

The one or more cameras 230 may be triggered by several different types of techniques. For instance, a Passive Infra Red (PIR) motion sensor may be built into the one or more cameras 230 and used to trigger the one or more cameras 230 to capture one or more images when motion is detected. The one or more cameras 230 also may include a microwave motion sensor built into the camera and used to trigger the camera to capture one or more images when motion is detected. Each of the one or more cameras 230 may have a "normally open" or "normally closed" digital input that can trigger capture of one or more images when external sensors (e.g., the sensors 220, PIR, door/window, etc.) detect motion or other events. In some implementations, at least one camera 230 receives a command to capture an image when external devices detect motion or another potential alarm event. The camera may receive the command from the controller 212 or directly from one of the sensors 220.

In some examples, the one or more cameras 230 triggers integrated or external illuminators (e.g., Infra Red, Z-wave controlled "white" lights, lights controlled by the module 222, etc.) to improve image quality when the scene is dark. An integrated or separate light sensor may be used to determine if illumination is desired and may result in increased image quality.

The sensors 220, the door knobs 222, and the cameras 230 communicate with the controller 212 over communication links 224, 226, and 228. The communication links 224, 226, and 228 may be a wired or wireless data pathway configured to transmit signals from the sensors 220, the door knobs 222, and the cameras 230 to the controller 212. The communication link 224, 226, and 228 228 may include a local network, such as, 802.11 "Wi-Fi" wireless Ethernet (e.g., using low-power Wi-Fi chipsets), Z-Wave, Zigbee, Bluetooth, "HomePlug" or other Powerline networks that operate over AC wiring, and a Category 5 (CAT5) or Category 6 (CAT6) wired Ethernet network.

The monitoring application server 260 is an electronic device configured to provide monitoring services by exchanging electronic communications with the monitor control unit 210, and the one or more user devices 240, over the network 205. For example, the monitoring application server 260 may be configured to monitor events (e.g., alarm events) generated by the monitor control unit 210. In this example, the monitoring application server 260 may exchange electronic communications with the network module 214 included in the monitoring system control unit 210 to receive information regarding events (e.g., alarm events) detected by the monitoring system control unit 210. The monitoring application server 260 also may receive information regarding events (e.g., alarm events) from the one or more user devices 240.

The one or more user devices 240 are devices that host and display user interfaces. The user device 240 may be a cellular phone or a non-cellular locally networked device with a display. The user device 240 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The user device 240 may perform functions unrelated to the monitoring system, such as placing personal telephone calls, playing music, playing video, displaying pictures, browsing the Internet, maintaining an electronic calendar, etc.

The user device 240 includes a native surveillance application 242. The native surveillance application 242 refers to a software/firmware program running on the corresponding mobile device that enables the user interface and features described throughout. The user device 240 may load or install the native surveillance application 242 based on data received over a network or data received from local media. The native surveillance application 242 runs on mobile devices platforms, such as iPhone, iPod touch, Blackberry, Google Android, Windows Mobile, etc. The native surveillance application 242 enables the user device 140 to receive and process image and sensor data from the monitoring system.

The central alarm station server 270 is an electronic device configured to provide alarm monitoring service by exchanging communications with the monitor control unit 210, the one or more user devices 240, and the monitoring application server 260 over the network 205. For example, the central alarm station server 270 may be configured to monitor alarm events generated by the monitoring system control unit 210. In this example, the central alarm station server 270 may exchange communications with the network module 214 included in the monitor control unit 210 to receive information regarding alarm events detected by the monitor control unit 210. The central alarm station server 270 also may receive information regarding alarm events from the one or more user devices 240.

The central alarm station server 270 is connected to multiple terminals 272 and 274. The terminals 272 and 274 may be used by operators to process alarm events. For example, the central alarm station server 270 may route alarm data to the terminals 272 and 274 to enable an operator to process the alarm data. The terminals 272 and 274 may include general-purpose computers (e.g., desktop personal computers, workstations, or laptop computers) that are configured to receive alarm data from a server in the central alarm station server 270 and render a display of information based on the alarm data. For instance, the controller 212 may control the network module 214 to transmit, to the central alarm station server 270, alarm data indicating that a sensor 220 detected a door opening when the monitoring system was armed. The central alarm station server 270 may receive the alarm data and route the alarm data to the terminal 272 for processing by an operator associated with the terminal 272. The terminal 272 may render a display to the operator that includes information associated with the alarm event (e.g., the name of the user of the alarm system, the address of the building the alarm system is monitoring, the type of alarm event, etc.) and the operator may handle the alarm event based on the displayed information.

In some implementations, the terminals 272 and 274 may be mobile devices or devices designed for a specific function. Although FIG. 2 illustrates two terminals for brevity, actual implementations may include more (and, perhaps, many more) terminals.

In some implementations, the one or more user devices 240 communicate with and receive monitoring system data from the monitor control unit 210 using the communication link 238. For instance, the one or more user devices 240 may communicate with the monitor control unit 210 using various local wireless protocols such as Wi-Fi, Bluetooth, Z-Wave, Zigbee, "HomePlug," or other Powerline networks that operate over AC wiring, or Power over Ethernet (POE), or wired protocols such as Ethernet and USB, to connect the one or more user devices 240 to local security and automation equipment. The one or more user devices 240 may connect locally to the monitoring system and its sensors and other devices. The local connection may improve the speed of status and control communications because communicating through the network 205 with a remote server (e.g., the monitoring application server 260) may be significantly slower.

Although the one or more user devices 240 are shown as communicating with the monitor control unit 210, the one or more user devices 240 may communicate directly with the sensors and other devices controlled by the monitor control unit 210. In some implementations, the one or more user devices 240 replace the monitoring system control unit 210 and perform the functions of the monitoring system control unit 210 for local monitoring and long range/offsite communication.

Other arrangements and distribution of processing is possible and contemplated within the present disclosure.

Figure 3:
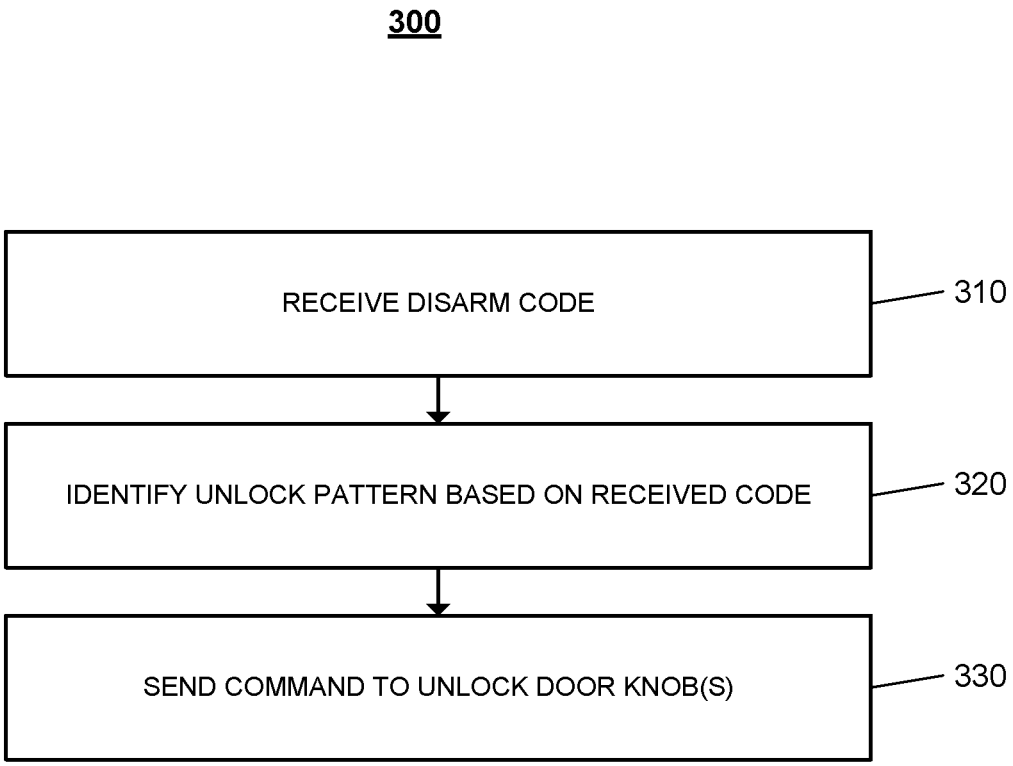
FIG. 3 is a flow chart of an example process for sending commands to unlock indoor door knobs.

FIG. 3 illustrates an example process 300 for sending commands to unlock door knobs. The control unit 112 receives a disarm code (310). The control unit 112 includes a user interface that allows a user to manually enter a code to disarm the in-home monitoring system. The user code is a user specific PIN code, or alphanumeric code that is set by a user associated with the monitored property. In some examples, the control unit 112 may be configured to receive a voice input of a disarm code from a user. In these examples, the user interface of the control unit is configured with a speaker to receive the voice input.

The control unit 112 identifies an unlock pattern based on the received disarm code (320). A user associated with the monitored property 102 may configure the in-home monitoring system with one or more disarm codes for different users. The user associated with the monitored property 102 may configure the disarm codes for the system by logging into a management account of the in-home monitoring system. During the configuration of the user codes, the user may also configure a door knob unlock pattern associated with each of the different disarm codes. The door knob unlock pattern identifies which of the one or more indoor door knobs at the monitored property 102 should be unlocked when the in-home security system is disarmed by a particular disarm code. Each of the configured disarm codes and the associated door knob unlock pattern are stored in memory at the control unit 112.

When a disarm code is entered into the user interface of the control unit 112, the control unit 112 verifies the entered code, and disarms the in-home security system. The control unit 112 simultaneously identifies the door knob unlock pattern associated with the entered disarm code. The user associated with the monitored property may configure a single disarm code to be used by each of the members of the family of the monitored property. The user may configure this code to unlock each of the one or more door knobs within the monitored property 102. The user may configure a guest disarm code to be used by someone other than a member of the family at the monitored property 112. The guest disarm code may be a time sensitive disarm code, and may be associated with a door knob unlock pattern that is different from the door knob unlock pattern associated with the disarm code used by the members of the family of the monitored property 102. For example, the guest disarm code may be used by a friend/neighbor that visits the monitored property to feed a pet when the family is away, and may be configured to unlock only the door knob of the door to the garage and door knob of the door of the panty with the pet food. For another example, the user may configure a technician disarm code which may be a time sensitive code that can be used by technician visiting the monitored property in the absence of the user. The technician disarm code may be configured to unlock only the door knob of the door to the HVAC room. The control unit 112 may be configured to store several different disarm codes and the associated door knob unlock patterns. The user may log into the management account to update the disarm codes and the associated door knob unlock patterns at any time.

The control unit sends commands to unlock one or more door knobs based on the identified unlock pattern (330). The control unit 112 identifies the unlock pattern associated with the entered disarm code and communicates via Bluetooth with the one or more door knobs to unlock the door knobs. In some examples, the control unit 112 may communicate the unlocking commands to the door knob using various local wireless protocols including Wi-Fi, Bluetooth, Z-Wave, Zigbee, "HomePlug," or other Powerline networks that operate over AC wiring, or wired protocols such as Ethernet and USB.

In some implementations, the user may disarm the in-home monitoring system using his mobile device. In these implementations, the user may launch the in-home monitoring system application and enter his user code to disarm the system. The control unit 112 then sends the command to unlock the one or more door knobs based on the received disarm code. In some other implementations, the property 102 may not be equipped with an in-home monitoring system. In these implementations, the user's mobile device may communicate directly with the door knobs to lock and or unlock the door knobs. The user may have an application that identifies each of the one or more door knobs, and the user can control the locking and unlocking of the door knobs through the application. In some examples, a door knob may automatically unlock when the user is within a threshold distance from the door knob, and may automatically lock when the user is outside of the threshold distance from the door knob. In these examples, the user may configure the threshold distance for each of the one or more door knobs.

Figure 4:
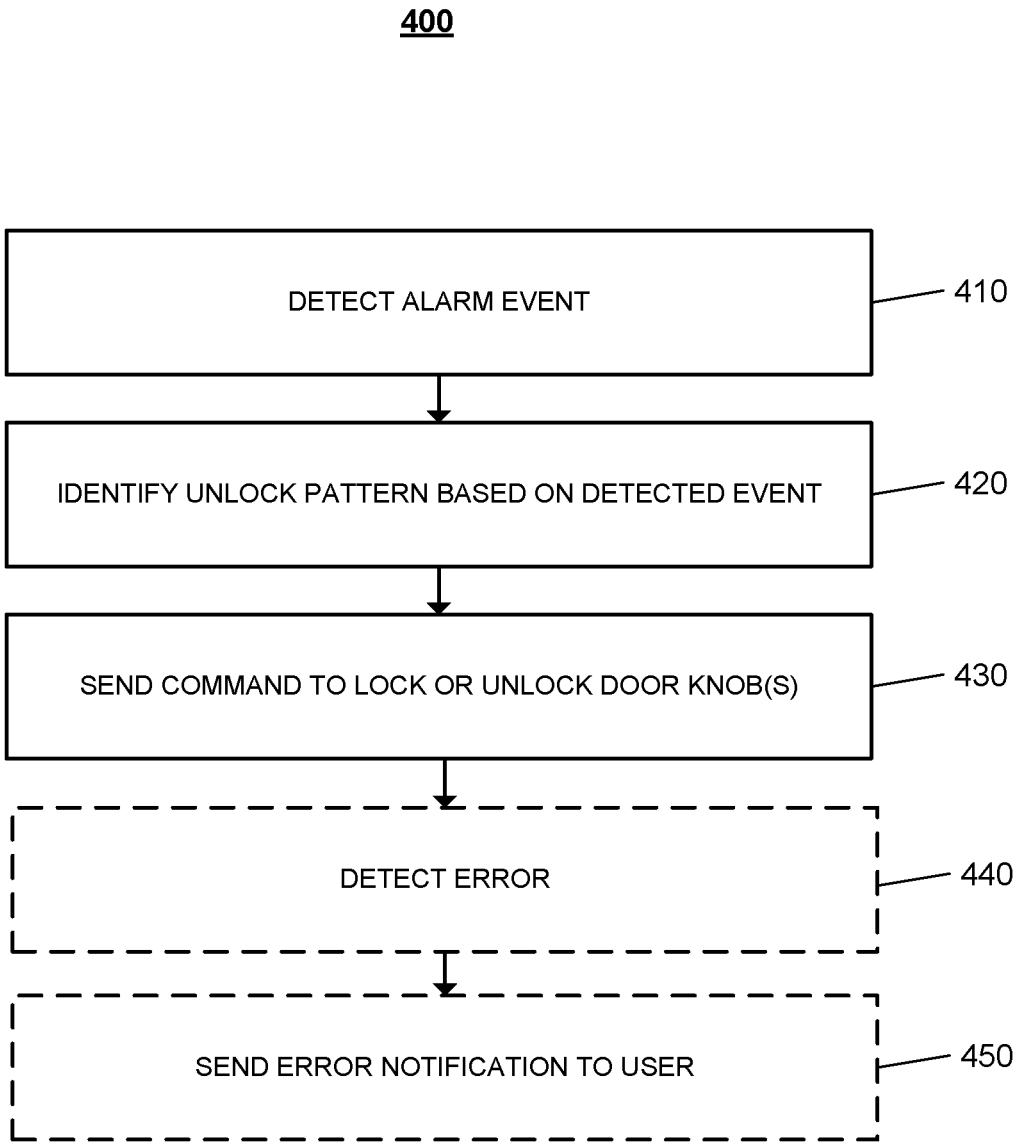
FIG. 4 illustrates an example process for sending an error notification to a user.

FIG. 4 illustrates an example process 400 for sending an error notification to a user. The control unit 112 detects an alarm event (410). The control unit 112 is in communication with one or more different sensors and may detect an alarm event from any of the one or more sensors. For example, a fire alarm may detect an alarm condition and communicate the detected alarm condition to the control unit, or a contact sensor may detect a window opening on the ground floor of the property and communicate the detected alarm event to the control unit. The data communicated from the sensor that detects an alarm condition may include the room in which the sensor is located, and may also include the identity of the door knob that controls access to the identified room.

The control unit 112 detects an alarm event within the monitored property based on receiving alarm condition data from at least one sensor. Based on detecting an alarm event, the control unit may sound an alarm. In some examples, the sensor detecting an alarm condition may sound an alarm. For example, a carbon monoxide sensor may sound an alarm when the detected levels of carbon monoxide exceed a threshold. The control unit 112 at the monitoring property 102 may in-turn communicate the detected alarm event to an external monitoring server 114. The monitoring sever 114 may be a server that is in communication with one or more other in-home monitoring systems. The monitoring server 114 may dispatch emergency personnel to the monitored property based on the detected alarm event. In some examples, the monitoring server 114 may send a notification to the user associated with the monitored property when the emergency personal is dispatched to the property.

The control unit 112 identifies the door knob lock/unlock pattern for the one or more door knobs based on the detected event (420). The control unit 112 may store in its memory a door knob lock/unlock pattern for the one or more door knobs based on a detected event. The door knob lock/unlock pattern is a pattern that identifies each of the one or more door knobs that must be locked, and each of the one or more door knobs that must be unlocked during a specific alarm event. The door knob lock/unlock pattern may be a pattern configured by the user associated with the monitored property. For example, the user may wish to unlock the door knobs to the doors to each of the bedrooms, and lock the door knob to a cabinet that stores flammable solvents if a fire event is detected. In some implementations, the door knob lock/unlock pattern may be a pattern configured by the control unit. For example, the control unit may lock the door knob to the door of a room when a contact sensor in the room detects a break in. In some implementations, the control unit may be configured with several different door knob lock/unlock patterns based on any conceivable detected event.

The control unit 112 sends commands to lock and/or unlock each of the one or more door knobs based on the identified door knob lock/unlock pattern (430). The control unit 112 identifies the unlock pattern associated with the particular detected alarm event and communicates via Bluetooth with the one or more door knobs to unlock the door knobs. In some examples, the control unit 112 may communicate the lock/unlocking commands to the door knob using various local wireless protocols including Wi-Fi, Bluetooth, Z-Wave, Zigbee, "HomePlug," or other Powerline networks that operate over AC wiring, or wired protocols such as Ethernet and USB.

In some implementations, the door knob lock/unlock pattern may be determined at the time of the detected event by an algorithm. The algorithm may be hosted on the control unit and may determine which of the one or more indoor door knobs that should be locked, and which should be unlocked to minimize the threat of an alarm event. For example, when a fire alarm detects a fire in a particular room of the monitored property, the fire alarm communicates the detected event to the control unit. The control unit may be configured to determine the location of each of the one or more occupants within the home, and based on the detected location of users within the home, the location of the fire alarm, and the location of the one or more door knobs, may determine an exit route for each of the occupants of the property. The control unit locks all of the door knobs on doors that do not align with the determined exit route, and unlocks the door knobs to doors along the exit routes. In these examples, the LED indicator light on the door knobs may light red to visually indicate to the occupants of the house the locked door knobs, and may light green to indicate the unlocked door knob. In some implementations, the unlocked door knobs may generate a sound to indicate which door knobs are unlocked and/or the locked door knobs may generate a different sound to indicate which door knobs are locked.

In some implementations, the control unit 112 may detect an error (440). An error may be detected when a door knob that has been commanded to be locked has failed to lock. For example, the control unit may communicate a locking command to a particular door knob, however, the door may not be in a closed position to facilitate the locking of the door knob. The door knob may then communicate the error data back to the control unit to indicate that the door knob has not been locked. The control unit 112 may detect an error message when an occupant is located in a room where the door should be locked. For example, the control unit may receive data from one or more motion detectors or cameras within a room which has a door knob that was commanded to be locked. Based on the detected alarm event, the control unit 112 may detect an error message and therefore would not lock the door knob to the room with the occupant. For example, the control unit may detect an alarm event due to high carbon monoxide levels in the monitored property, based on the detected event, the control unit 112 may send commands to unlock the doors along an exit route of the property and lock the doors to the bathrooms.

Each of the door knobs may be configured to allow a user to manually unlock a locked door knob in emergency situations. The door knob may be programmed to respond to a "hand shake" to unlock the door knob. The "hand shake" may be a particular series of manual movements that unlock a locked door knob. The hand shake may be configurable by the user. For example, the user may be able to turn the door knob left twice and right three times to manually unlock the door knob.

In some implementations, the control unit 112 may send an error notification to a user based on the detected error (450). The notification may be sent via a text message, SMS message, or email to the mobile device of one or more user associated with the monitored property. The message may include the description of the event and the detected error. In some implementations, the user may have the ability to ignore the error message and allow the control unit to lock or unlock a particular door.

Figure 5:
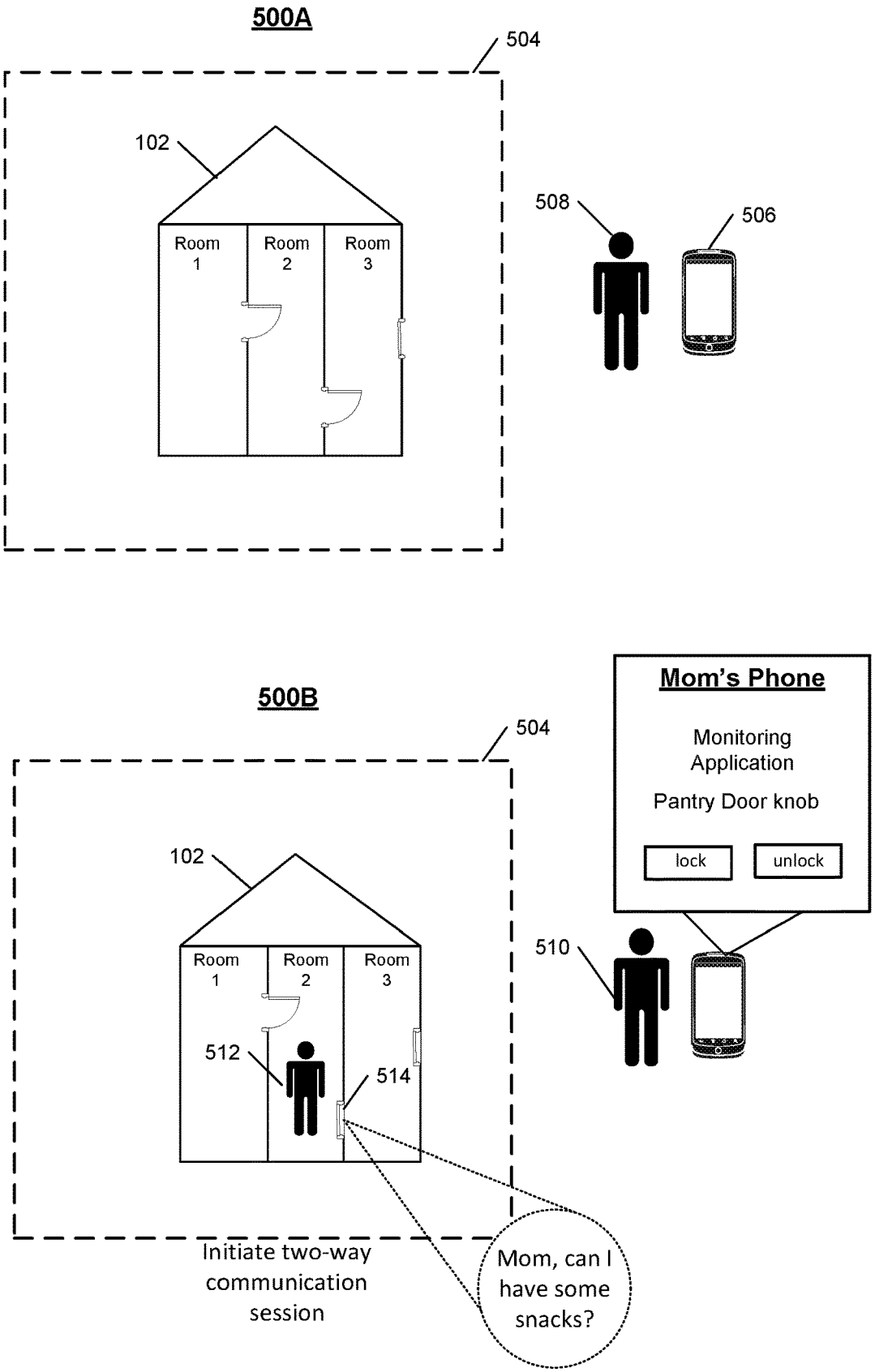
FIG. 5 illustrates an example of locking door knobs within a property based on the location of a user.

FIG. 5 illustrates examples of door knob lock/unlock patterns based on the geographical location of a user. The control unit 112 automatically locks/unlocks the one or more door knobs at the monitored property 102 based on a door knob lock/unlock pattern associated with a particular user. A user at the monitored property may have the ability to configure a pattern of locked and unlocked doors based on whether a particular user is outside of the monitored property. As shown in 500A, when the geographic location of the user 508 is determined to be outside of the geo-fence 504 of the monitored property 102, the control unit communicates with each of the door knobs to automatically lock or unlock the door knobs based on the door knob lock/unlock pattern associated with the user 508. For example, as illustrated, when the user 508 is outside of the property's geo-fence, the door knobs to room 1 and room 2 are unlocked, and the door knob to room 3 is locked. As illustrated in 500B, when a second user 510 is determined to be outside of the geo-fence 504 of the monitored property 102, the door knobs to room 1 is unlocked, and the door knobs to room 2 and room 3 are locked.

In some implementations, a user may initiate a two-way voice communication session with a second user associated with the monitored property through the speaker of a door knob. For the example illustrated in 500B, when user 510, Mom, is outside of the monitored property, the door knob leading to the pantry 514 is one of the door knobs that is automatically locked by the control unit. A child user 512 may want to access the pantry to grab some snacks, but because the door knob is locked, the child 512 may initiate a two-way communication session through the speaker of the door knob to request Mom 510 unlock the door knob to the pantry. In some examples, the child 512 may turn the door knob to initiate the two-way communication. In other examples, the child 512 may initiate the two-way communication session by speaking a command to the door knob 514. When the child 512 initiates a communication session with the door knob, the Mom 510 receives a notification through the monitoring application to accept the two-way communication session. The mom may respond through the speaker on her mobile device to the child, and may unlock the door knob through the application to allow the child to grab the snacks.

In some implementations, the door knobs may be used by users within the monitored property 102 for door knob to door knob voice communication. For example, a user in one room may initiate communication with a user in a second room. In other implementations, during an alarm event, a user within the monitored property may communicate with the monitors at the monitoring server. For example, during a fire, someone may be trapped in a room and may use the door knob on the door of the room to initiate a communication session. The communication session may be directly communicated to the monitoring server because the control unit detected an alarm event.

Figure 6:
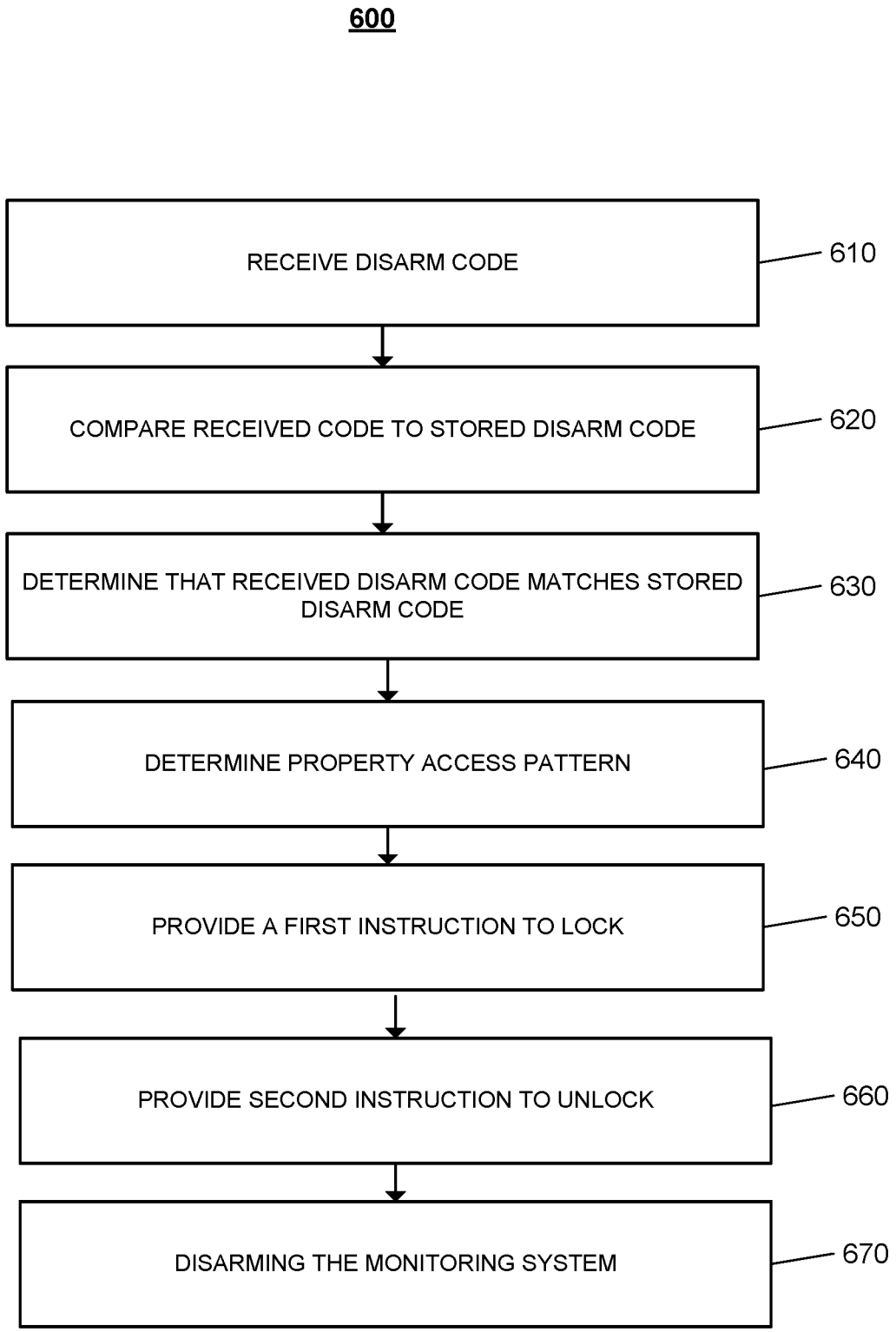
FIG. 6 is a flow chart of an example process for disarming a monitoring system.

FIG. 6 illustrates an example process 600 for disarming a monitoring system. The control unit receives a disarm code from a user (610). The control unit 112 includes a user interface that allows the user to manually enter a disarm code to disarm the in-home monitoring system. The disarm code is a user specific PIN code, or alphanumeric code that is set by an administrative user associated with the monitored property. In some examples, the control unit 112 may be configured to receive a voice input of a disarm code from the user. In these examples, the user interface of the control unit is configured with a speaker to receive the voice input.

The administrative user may be a resident of the monitored property, and may configure one or more disarm codes that are used to disarm the monitoring system at the monitored property 102. The user may assign the one or more specific disarm codes by logging into an access pattern website supported by the monitoring system, or by accessing an application that is hosted on a mobile device. The user may assign a specific disarm code for each of the members of the family residing at the monitored property 102. The user assigns the door knob lock/unlock pattern to each of the one or more disarm codes, which reflects the level of access granted to the assigned user.

The user may also assign one or more disarm codes to one or more visitors to the property. The user may assign disarm codes that allow different visitors to have different levels of access to the rooms of the property based on the door knob lock/unlock pattern associated with the assigned disarm code. For example, the user may assign a disarm code for a dog walker and assign the door knob lock/unlock pattern based on the disarm code. The code assigned to the dog walker only unlocks the door knobs to the doors that are used to access the dog and the leash. For example, the code may unlock the door knobs to the doors to the main living area, and lock all the other door knobs within the property.

The control unit compares the received disarm code to a stored disarm code (620). The control may have stored in its memory the one or more disarm codes assigned to the one or more family members and the one or more visitors to the property. When a user enters a disarm code at the user interface of the control panel, the control unit compares the received disarm code to the one or more disarm codes stored in memory. The control unit determines that the received disarm code matches the stored disarm code (630). Based on comparing the received disarm code to the one or more disarm codes stored in its memory, the control unit determines that the received code matches at least one disarm code stored in memory.

The control unit determines a property access pattern that corresponds to the stored disarm code (640). The control unit identifies the door lock/unlock pattern associated with the disarm code entered by the user. The property access pattern identifies a first group of one or more doors within the monitored property to lock, and a second group of one or more doors to unlock. The control unit may generate an alert when at least one door receives instruction to lock and is unable to be locked. A door may be unable to be locked when the door receives instruction to be lock and the door is not in a closed position.

The control unit provides a first instruction to lock to the first door group (650). The control unit 112 communicates via Bluetooth with the one or more doors of the first door group to lock the one or more doors. In some examples, the control unit 112 may communicate the commands to the one or more doors using various local wireless protocols including Wi-Fi, Bluetooth, Z-Wave, Zigbee, "HomePlug," or other Powerline networks that operate over AC wiring, or wired protocols such as Ethernet and USB. The control unit provides a second instruction to unlock to the second door group (660). The control unit 112 communicates via Bluetooth with the one or more doors of the second door group to unlock the one or more doors. In some examples, the control unit 112 may communicate the commands to the one or more doors using various local wireless protocols including Wi-Fi, Bluetooth, Z-Wave, Zigbee, "HomePlug," or other Powerline networks that operate over AC wiring, or wired protocols such as Ethernet and USB.

The control unit disarms the monitoring system (670). The control unit simultaneously disarms the monitoring system at the monitored property when the first instruction to lock the one or more doors of the first door group and the second instruction to unlock the one or more doors of the second door group are provided. In some implementations, the control unit instructs the one or more doors of the first door group to lock and the one or more doors of the second door group to unlock before disarming the monitoring system.

In some implementations, a property access pattern may be associated with the one or more different armed statuses of the monitoring system at the monitored property. The administrative resident of the monitored property may assign a property access pattern to be implemented for each of the armed statuses through the mobile application. For example, the user may set the property access pattern to lock each of the one or more doors when the monitoring system is armed away, and to unlock each of the one or more doors when the monitoring system is armed stay. When the control unit receives a request to arm the monitoring system to armed away, the control unit determines the property access pattern associated with the armed away status, and provides instructions to lock and or unlock the one or more doors based on the request. When the control unit receives a request to arm the monitoring system to armed stay, the control unit determines the property access pattern associated with the armed stay status, and provides instructions to lock and or unlock the one or more doors based on the request.

In some implementations, the control unit may instruct one or more doors to lock and or unlock based on detecting an alarm condition at the monitored property. In these implementations, the control unit receives data from one or more sensors throughout the monitored property. For example, a fire alarm may detect an alarm condition and communicate the detected alarm condition to the control unit, or a contact sensor may detect a window opening on the ground floor of the property and communicate the detected alarm event to the control unit. The data communicated from the sensor that detects an alarm condition may include the room in which the sensor is located, and may also include the identity of the door that controls access to the identified room. When the control unit receives the data from the sensor indicating an alarm condition, the control unit may instruct one the door to the with the detected alarm condition to lock. For example, when a contact sensor on the ground floor is triggered, the control unit may instruct the door to the room to be locked to prevent access to the other rooms of the monitored property.

In some implementations, the control unit at the monitored property may receive data from an external crime data server. The external crime data server may provide the control unit with real-time crime conditions for the location of the monitored property. In some examples, the crime data may include historical crime data that represents crime data that has been collected over a period of time. For example, the crime data may include data collected over the past year. The crime data may include crime data that identifies patterns of crime that occur at a particular time of the year, and may identify periods of time when crime is likely to occur based on the historical data. For example, the crime data may specific that burglaries typically occur between 11:00 AM and 3:00 PM on Tuesday. In some implementations, the external crime data server may receive data from one or more control units at one or more monitored properties.

The control unit may command the one or more doors of the monitored property to lock or unlock based on crime data received from the crime data server. For example, the control unit may receive crime data that indicates a burglary just occurred in the neighborhood of the monitored property. Based on the received crime data, the control unit may instruct the one or more doors to the rooms on the ground floor to be locked.

In some implementations, each of the one or more door knobs may be configured to lock from either side of the door. For example, the user may lock a door from the side of the door that is inside the room or the user may lock the door from the side of the door that is outside the room.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially-designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

The invention claimed is:

1. A monitoring system comprising:

one or more door knobs that are located on doors inside a property and that are configured to lock and unlock in response to instructions from a monitor control unit, a monitor control unit that is configured to:

determine that a user is outside of a geo-fence;

based on determining that the user is outside of the geo-fence, determine a property access pattern that identifies a first door group of one or more doors inside the property that should be locked, and that identifies a second door group of one or more doors inside the property that should be unlocked;

provide, to the first door group, a first instruction to lock; and provide, to the second door group, a second instruction to unlock.

2. The monitoring system of claim 1, wherein the monitor control unit is further configured to:

determine whether a second user is outside of the geo-fence;

based on determining that the second user is outside of the geo-fence, determine a second property access pattern that identifies a third door group of one or more doors inside the property that should be locked, and that identifies a fourth door group of one or more doors inside the property that should be unlocked;

provide, to the third door group, a third instruction to lock; and provide, to the fourth door group, a fourth instruction to unlock.

3. The monitoring system of claim 1, wherein determine that a user is outside of a geo-fence comprises:

determine that a mobile device of the user indicates that the user is outside of the geo-fence.

4. The monitoring system of claim 1, wherein the monitor control unit is further configured to:

determine that a second user at the property is initiating a communication session with the user outside of the property;

receive, from the user outside of the property, an instruction to unlock a particular door; and provide, to the particular door, a third instruction to unlock.

5. The monitoring system of claim 4, wherein determine that a second user at the property is initiating a communication session with the user outside of the property comprises:

determine that the second user has turned a door knob of the particular door.

6. The monitoring system of claim 4, wherein determine that a second user at the property is initiating a communication session with the user outside of the property comprises:

determine that the second user has spoken a command to a door knob of the particular door.

7. The monitoring system of claim 4, wherein receive, from the user outside of the property, an instruction to unlock a particular door comprise:

provide, to a mobile device of the user outside of the property, a notification to accept the communication session; and receive the instruction to unlock the particular door through an application on the mobile device.

8. A computer-implemented method, comprising:

determining that a user is outside of a geo-fence;

based on determining that the user is outside of the geo-fence, determining a property access pattern that identifies a first door group of one or more doors inside the property that should be locked, and that identifies a second door group of one or more doors inside the property that should be unlocked;

providing, to the first door group, a first instruction to lock; and providing, to the second door group, a second instruction to unlock.

9. The computer-implemented method of claim 8, comprising:

determining whether a second user is outside of the geo-fence;

based on determining that the second user is outside of the geo-fence, determining a second property access pattern that identifies a third door group of one or more doors inside the property that should be locked, and that identifies a fourth door group of one or more doors inside the property that should be unlocked;

providing, to the third door group, a third instruction to lock; and providing, to the fourth door group, a fourth instruction to unlock.

10. The computer-implemented method of claim 8, wherein determining that a user is outside of a geo-fence comprises:

determining that a mobile device of the user indicates that the user is outside of the geo-fence.

11. The computer-implemented method of claim 8, comprising:

determining that a second user at the property is initiating a communication session with the user outside of the property;

receiving, from the user outside of the property, an instruction to unlock a particular door; and providing, to the particular door, a third instruction to unlock.

12. The computer-implemented method of claim 11, wherein determining that a second user at the property is initiating a communication session with the user outside of the property comprises:

determining that the second user has turned a door knob of the particular door.

13. The computer-implemented method of claim 11, wherein determining that a second user at the property is initiating a communication session with the user outside of the property comprises:

determining that the second user has spoken a command to a door knob of the particular door.

14. The computer-implemented method of claim 11, wherein receiving, from the user outside of the property, an instruction to unlock a particular door comprise:

providing, to a mobile device of the user outside of the property, a notification to accept the communication session; and receiving the instruction to unlock the particular door through an application on the mobile device.

15. A non-transitory computer-readable medium storing software comprising instructions executable by one or more computers which, upon such execution, cause the one or more computers to perform operations comprising:

determining that a user is outside of a geo-fence;

based on determining that the user is outside of the geo-fence, determining a property access pattern that identifies a first door group of one or more doors inside the property that should be locked, and that identifies a second door group of one or more doors inside the property that should be unlocked;

providing, to the first door group, a first instruction to lock; and providing, to the second door group, a second instruction to unlock.

16. The non-transitory computer-readable medium of claim 15, the operations comprising:

determining whether a second user is outside of the geo-fence;

based on determining that the second user is outside of the geo-fence, determining a second property access pattern that identifies a third door group of one or more doors inside the property that should be locked, and that identifies a fourth door group of one or more doors inside the property that should be unlocked;

providing, to the third door group, a third instruction to lock; and providing, to the fourth door group, a fourth instruction to unlock.

17. The monitoring system non-transitory computer-readable medium of claim 15, wherein determining that a user is outside of a geo-fence comprises:

determining that a mobile device of the user indicates that the user is outside of the geo-fence.

18. The non-transitory computer-readable medium of claim 15, the operations comprising:

determining that a second user at the property is initiating a communication session with the user outside of the property;

receiving, from the user outside of the property, an instruction to unlock a particular door; and providing, to the particular door, a third instruction to unlock.

19. The non-transitory computer-readable medium of claim 18, wherein determining that a second user at the property is initiating a communication session with the user outside of the property comprises:

determining that the second user has turned a door knob of the particular door.

20. The non-transitory computer-readable medium of claim 18, wherein determining that a second user at the property is initiating a communication session with the user outside of the property comprises:

determining that the second user has spoken a command to a door knob of the particular door.

* * * * *